US007527543B2

(12) United States Patent
Chang

(10) Patent No.: US 7,527,543 B2
(45) Date of Patent: May 5, 2009

(54) HIGH ELASTIC FIBER CUP

(75) Inventor: Yuan-Shang Chang, Taipei (TW)

(73) Assignee: Pinheh Mas Co., Ltd., Taipei (TW)

( * ) Notice: Subject to any disclaimer, the term of this patent is extended or adjusted under 35 U.S.C. 154(b) by 0 days.

(21) Appl. No.: 11/777,433

(22) Filed: Jul. 13, 2007

(65) Prior Publication Data

US 2009/0017725 A1 Jan. 15, 2009

(51) Int. Cl.
*A41C 3/00* (2006.01)

(52) U.S. Cl. ..... 450/93; 450/39; 450/57; 450/54; 2/267; 2/268

(58) Field of Classification Search ..... 2/267, 2/268; 450/37–39, 54–58; 623/7, 8
See application file for complete search history.

(56) References Cited

U.S. PATENT DOCUMENTS 3,845,507 A * 11/1974 Kirby et al. ..... 623/7
4,019,209 A * 4/1977 Spence ..... 623/7
5,352,307 A * 10/1994 Wild ..... 156/66
5,792,292 A * 8/1998 Wild ..... 156/66
5,922,023 A * 7/1999 Mulligan et al. ..... 623/7
6,101,630 A * 8/2000 Lee ..... 2/57
6,283,820 B1 * 9/2001 Huang ..... 450/57
7,252,574 B2 * 8/2007 Chen ..... 450/38

* cited by examiner

*Primary Examiner*—Gloria Hale
(74) *Attorney, Agent, or Firm*—Alan Kamrath; Kamrath & Associates PA

(57) ABSTRACT

A high elastic fiber cup includes an inner layer, an outer layer and a pad. The inner and outer layers include wrapping clothes having high elastic fiber bodies attached on the inner surfaces thereof and cut into combed fiber sheets, respectively, or include a double-side multispandex or a three-layer of elastic fiber knitting cloth. The pad is made of a high elastic fiber body which is cut into a three-dimensional block and is attached to and between the inner and outer layers by using gel. An excellent elasticity and air permeability is obtained for recovering its initial shape quickly after being pressed and achieving a comfortable satisfaction.

8 Claims, 13 Drawing Sheets

HIGH ELASTIC FIBER CUP

BACKGROUND OF THE INVENTION

1. Field of the Invention

The present invention relates to a cup and, more particularly, to a high elastic fiber cup that may have an excellent elasticity and air permeability so as to recover its initial shape quickly after being pressed and to achieve a comfortable satisfaction.

2. Description of the Prior Arts

A bra is necessary for daily use for protecting and supporting women's breasts and further for forming a concentratedly erect breast. Referring to FIG. 1, a prior art cup for use in bras comprises two liner cloths 1 each made of a double-side multispandex and including a pad 2 formed therebetween and made of silk wadding, foam or non-woven fabric individually.

However, the pad 2 made of silk wadding is easily deforms after long-term use or repeated washings. Such pads are also uncomfortable.

The pad 2 made of foam is heavy and thereby becomes deformed from their excessive weight and will also fade in color after being washed.

When the pad 2 is made of non-woven fabric, such fabric is not hard enough to support a user's breast.

The present invention has arisen to mitigate and/or obviate the afore-described disadvantages.

SUMMARY OF THE INVENTION

The primary object of the present invention is to provide a high elastic fiber cup that may have an excellent elasticity and air permeability so as to recover its initial shape quickly after being pressed and to achieve a comfortable satisfactory use.

Another object of the present invention is to provide a high elastic fiber cup that may prolong the service life thereof, even though the cup is washed repeatedly after use.

In accordance with one aspect of the present invention, there is provided a high elastic fiber cup comprising an inner layer, an outer layer and a pad. In a preferred forms, the inner and outer layers include wrapping cloths having high elastic fiber bodies attached on the inner surfaces thereof and cut into combed fiber sheets respectively. In alternate forms, the inner and outer layers include a double-side multispandex or a three-layer of elastic fiber knitting cloth. The pad is made of a high elastic fiber body which is cut into a three-dimensional block and is attached to and between the inner and outer layers by using gel. Thereafter, a high elastic and air permeable cup is formed in a hot pressing or a sewing manner.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
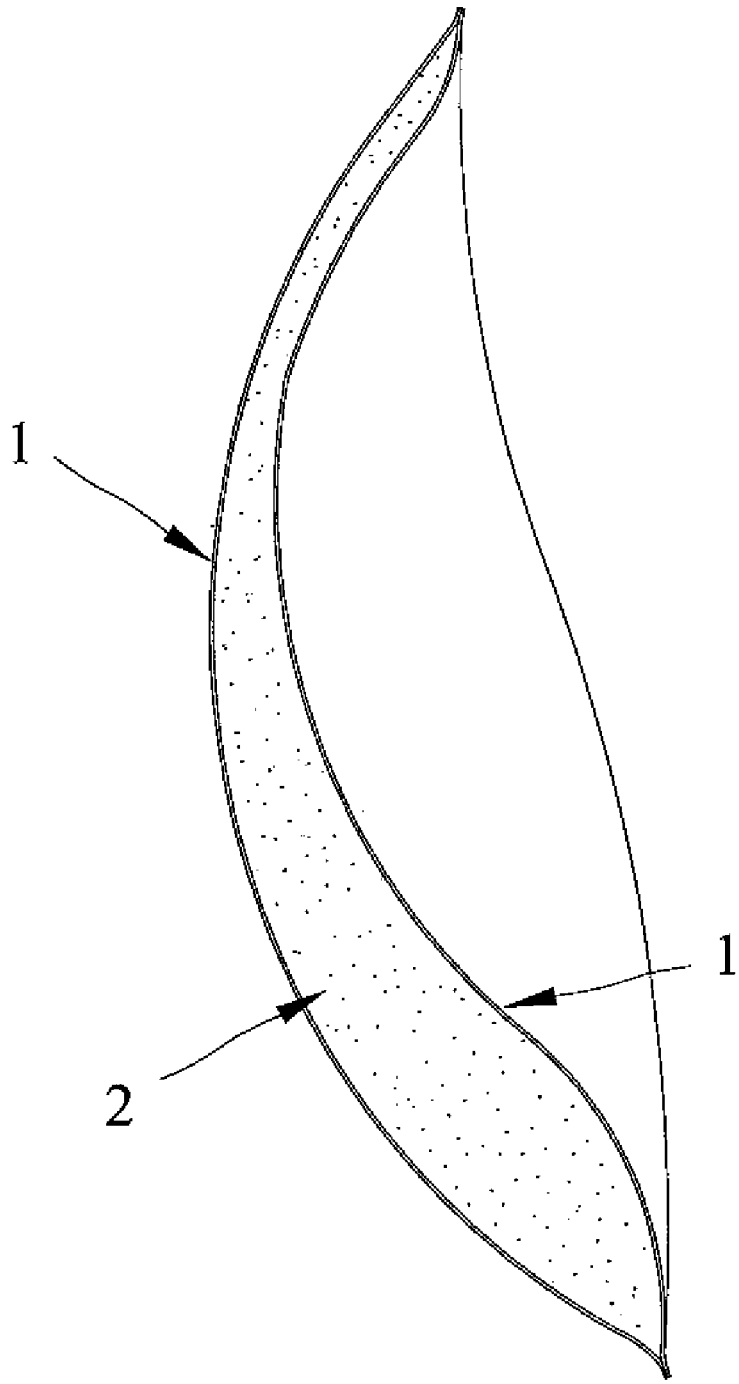
FIG. 1 PRIOR ART
FIG. 1 is a cross sectional diagram illustrating the assembly of a prior art cup for use in bras.
Figure 2:
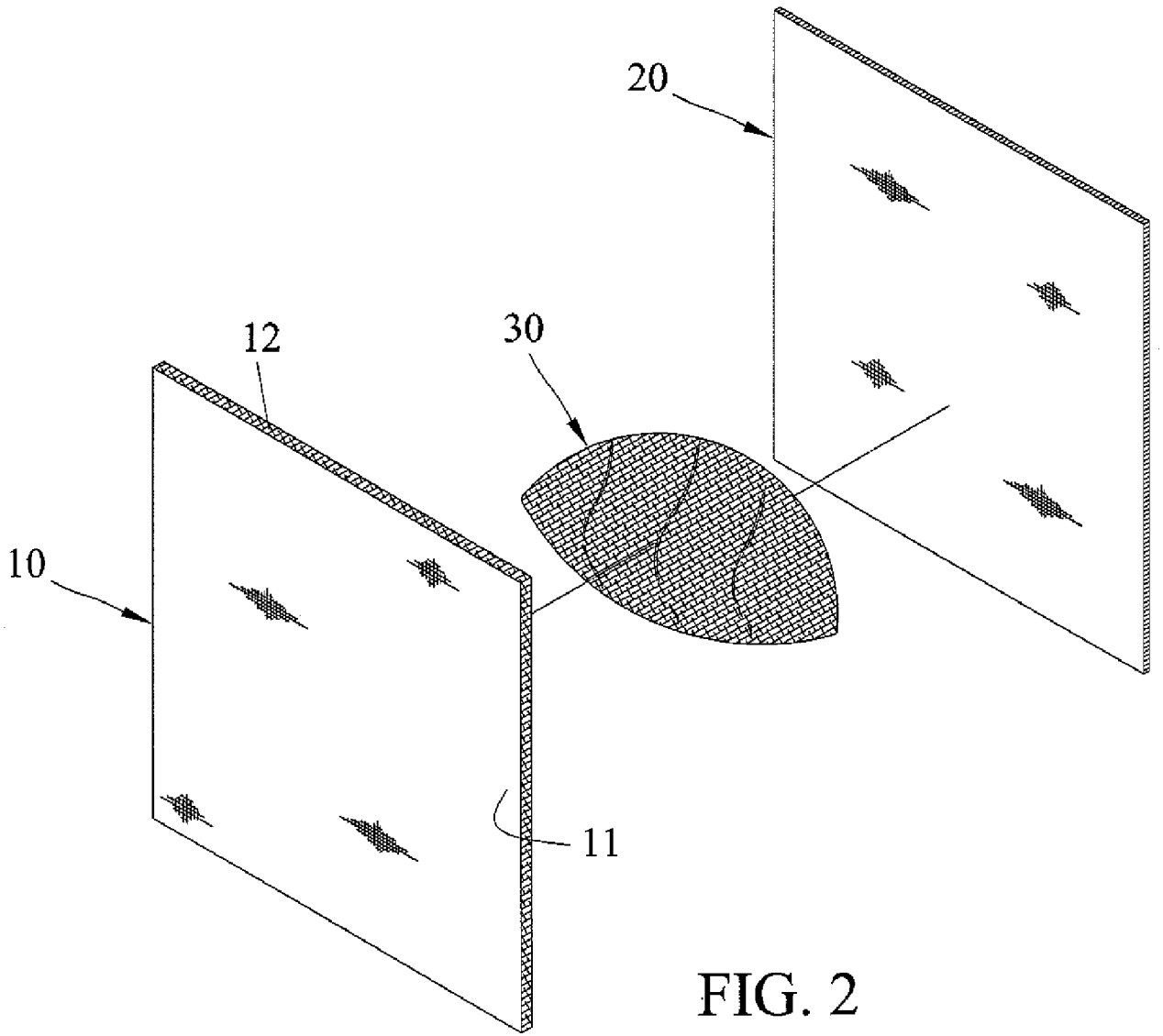
FIG. 2 is a perspective diagram illustrating the exploded components of a high elastic fiber cup according to a first embodiment of the present invention.
Figure 3:
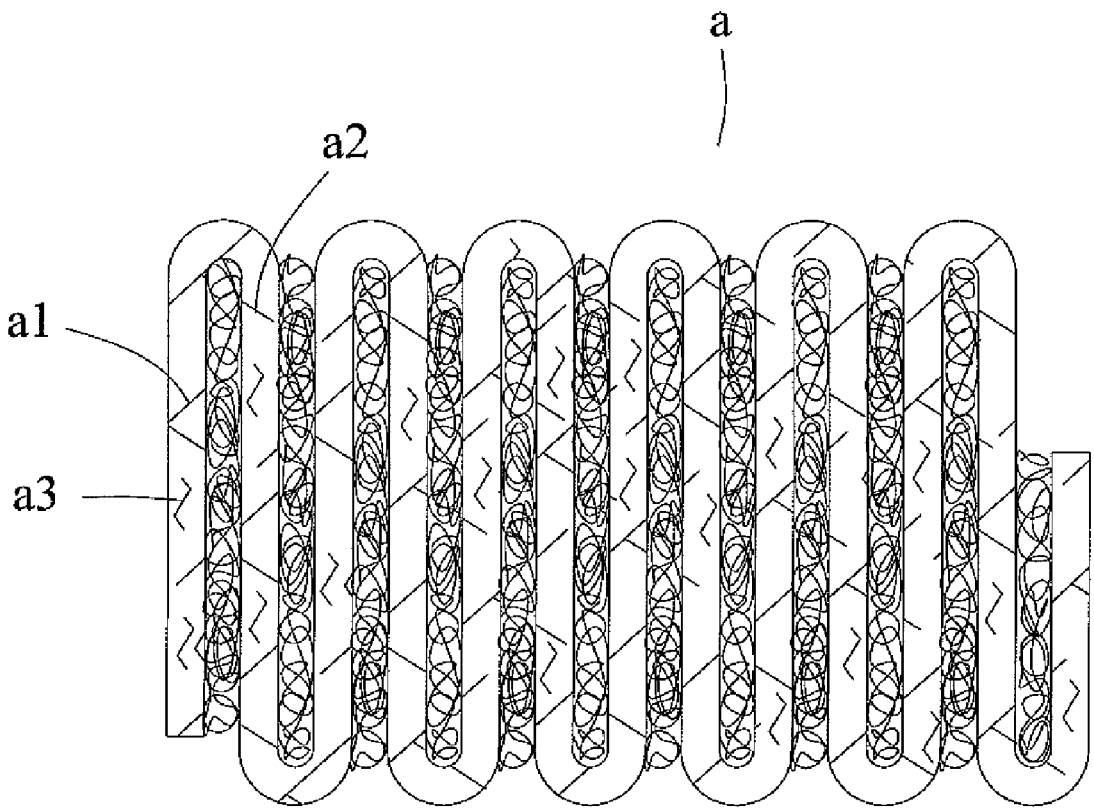
FIG. 3 is a cross sectional diagram of a high elastic fabric body of the high elastic fiber cup according to the present invention.
Figure 4:
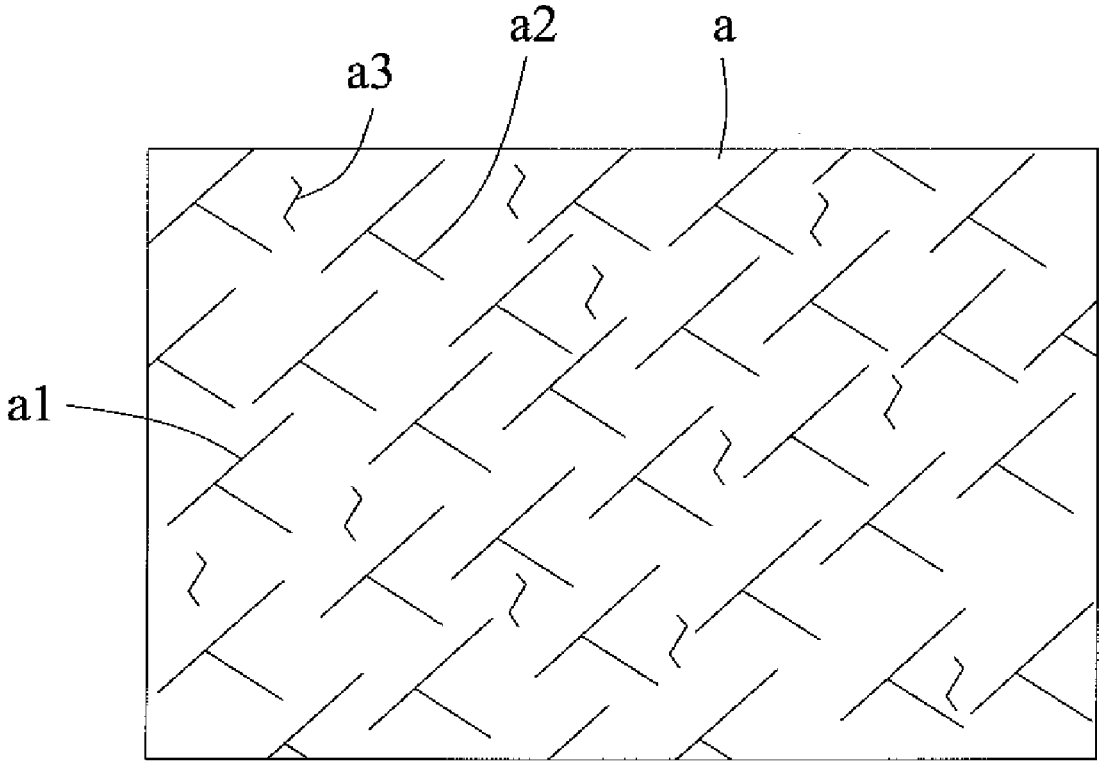
FIG. 4 is a plane diagram illustrating the exploded components of the high elastic fabric body of the high elastic fiber cup according to the present invention.
Figure 5:
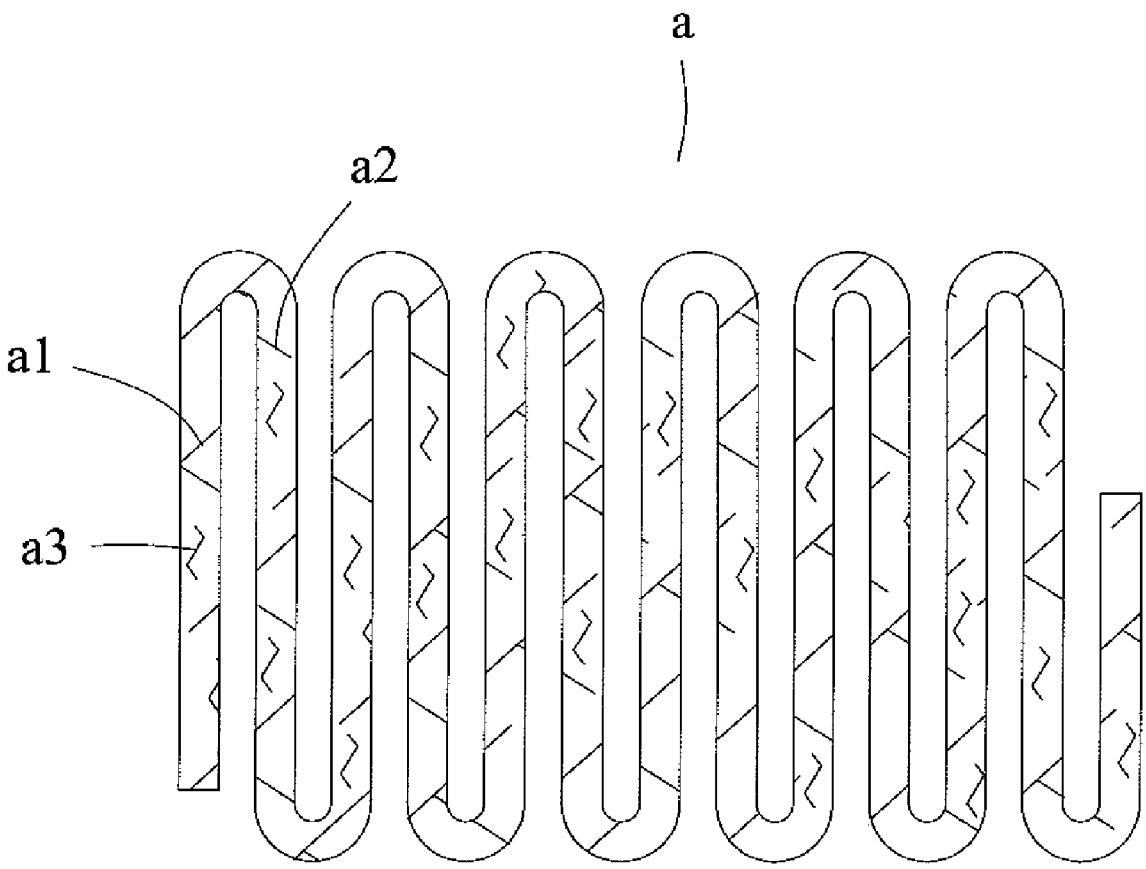
FIG. 5 is a cross sectional diagram illustrating the manufacturing state of the high elastic fabric body of the high elastic fiber cup according to the present invention.
Figure 6:
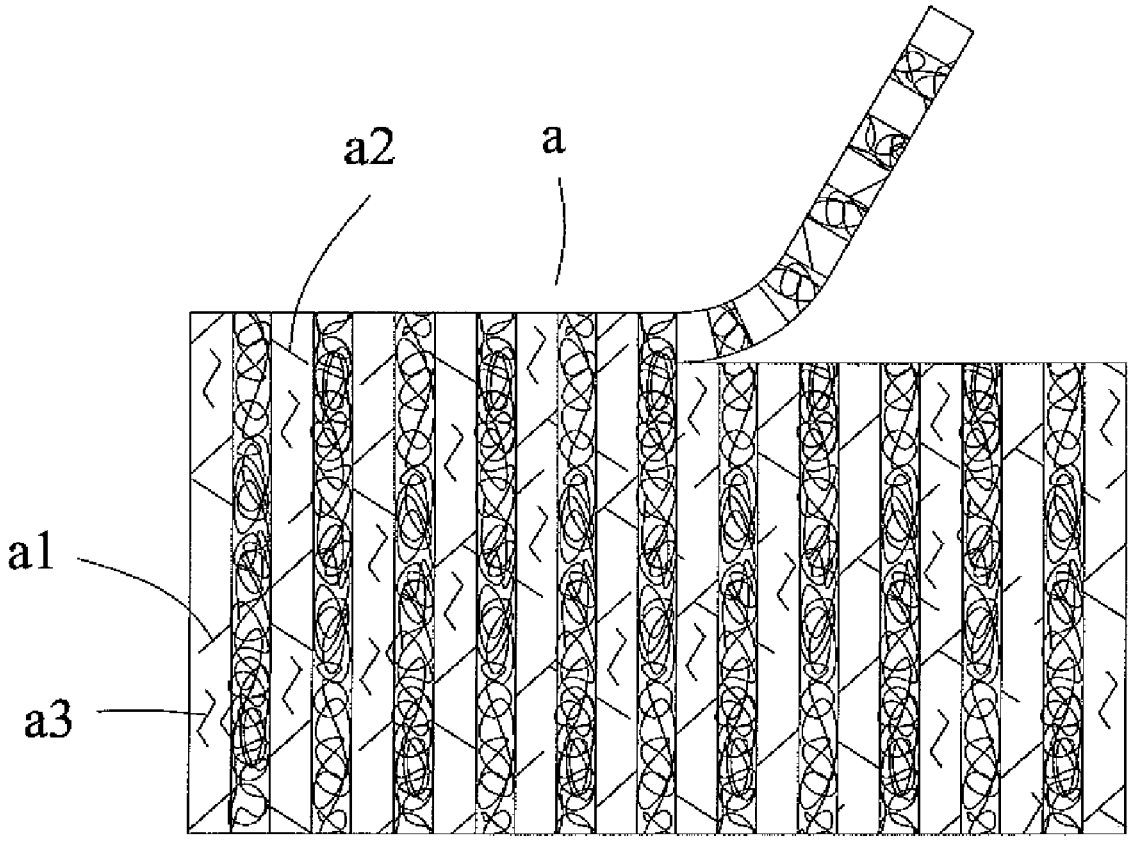
FIG. 6 is a plane diagram illustrating the high elastic fabric body of the high elastic fiber cup of the present invention being cut into pieces.
Figure 7:
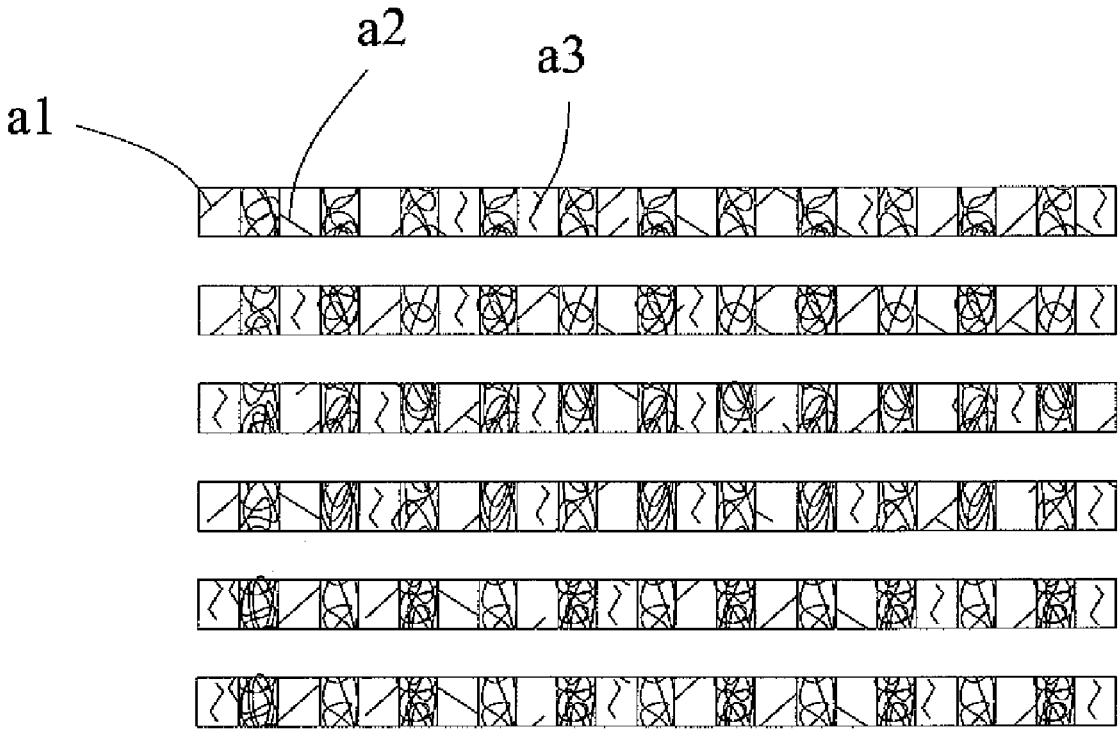
FIG. 7 is a plane diagram illustrating the high elastic fabric body of the high elastic fiber cup of the present invention being cut into combed fiber sheets.

Referring to FIGS. 2-7, a high elastic fiber cup in accordance with the present invention comprises an inner layer 10, an outer layer 20 and a pad 30. The inner layer 10 includes a wrapping cloth 11 having a combed fiber sheet 12 attached on the inner surface thereof and provided with a proper thickness. The combed fiber sheet 12 is made of at least two fibers, wherein one of the fibers is a Low Melt PET elastic fiber a1 and its proportion mixed in the combed fiber sheet 12 is about 45% to 50%, yet another of the fibers is a self-crimp PET fiber a2 and its proportion mixed in the combed fiber sheet 12 is about 45% to 50% as well. To accommodate different melting points of the PET fibers a1 and a2, another fiber a3 including cotton, recycled cloth material, previously used weaving material, previously used carpet, and recycled cotton combined together is added into the combed fiber sheet 12 and its proportion mixed therein is around 5% to 10%. It is to be noted that after combining cotton, recycled cloth material, previously used weaving material, previously used carpet, and recycled cotton combined together, the combined fiber structure is released by using a fiber opening machine and then advanced into carding machines for expanding the fiber structure to form a successive fiber web. The fiber web is conveyed to a fiber folding machine for being parallelly folded. Thereafter, the fiber web is heated in a bake box by way of 150° C. to 200° C. heated wind so that the overheated PET fiber becomes twisted and retractably combines with the low melting-point PET elastic fiber to form a vertically-combed high elastic fiber body a. Then, the high elastic fiber body a is rolled and cut into fiber sheets by a cutting machine. The outer layer 20 is made of a double-side multispandex, and the pad 30 is made of the high elastic fiber body a which is cut into a three-dimensional block.

Figure 9:
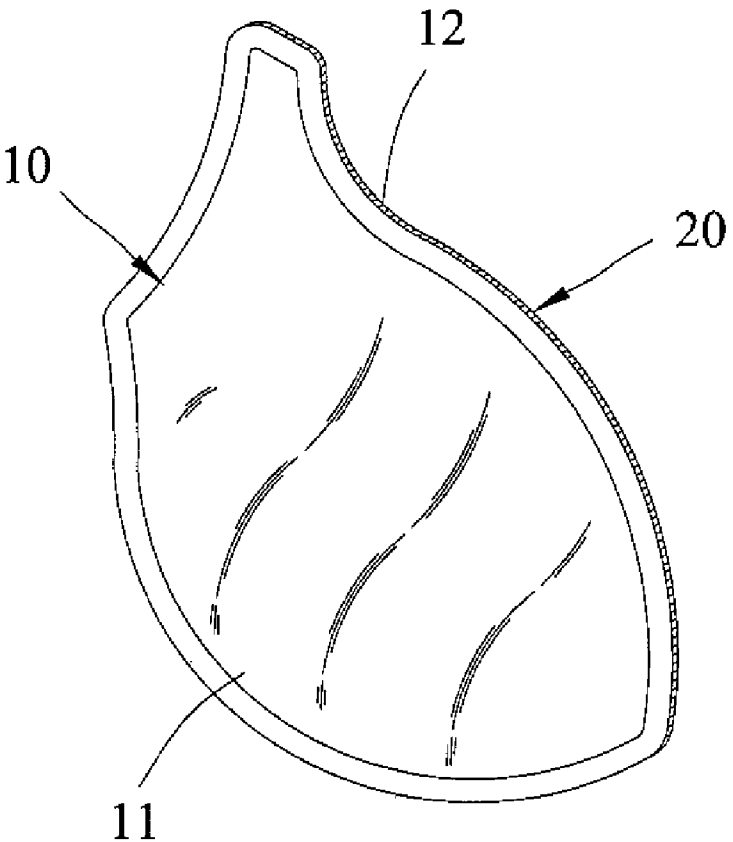
FIG. 9 is a perspective diagram illustrating the high elastic fiber cup of the first embodiment of the present invention being formed.
Figure 8:
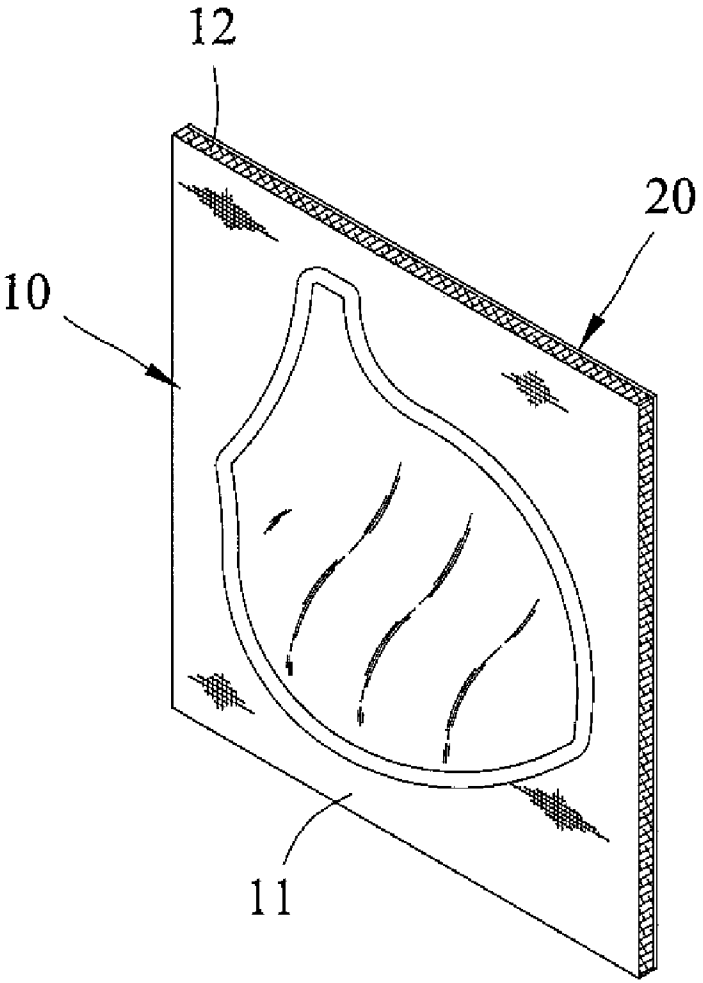
FIG. 8 is a perspective diagram illustrating the high elastic fiber cup of the first embodiment of the present invention being hot pressed.
Figure 10:
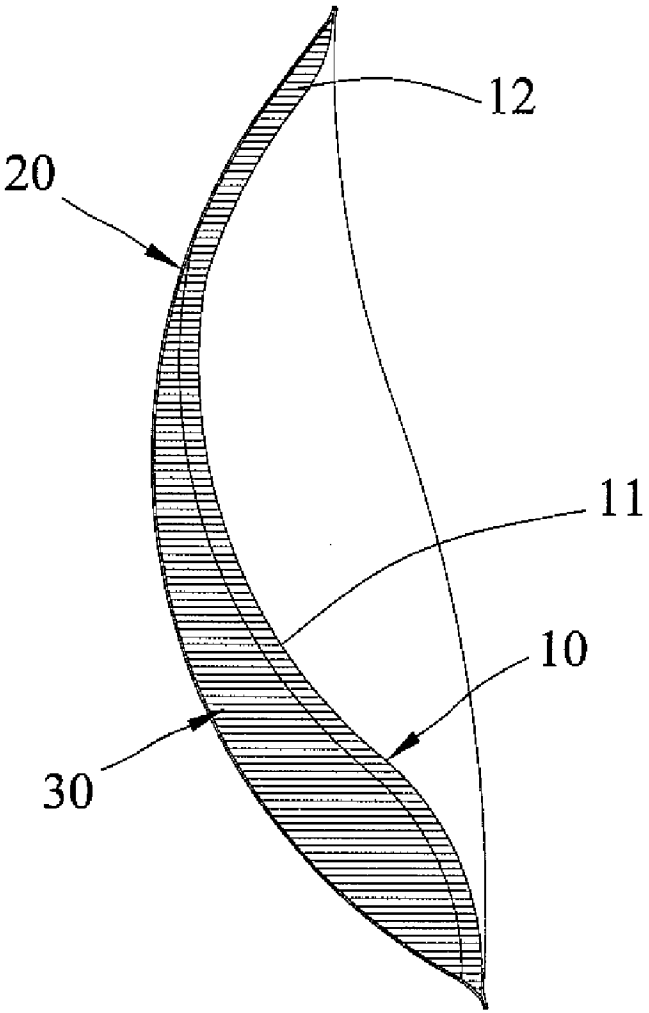
FIG. 10 is a cross sectional diagram of the high elastic fiber cup according to the first embodiment of the present invention.

In assembly, as shown in FIGS. 8-10, the inner and outer layers 10, 20 are applied on the inner surfaces thereof with gel. The pad 30 is attached to and between the inner and outer layers 10, 20 and, then, hot pressed to form a high elastic and air permeable cup.

Figure 11:
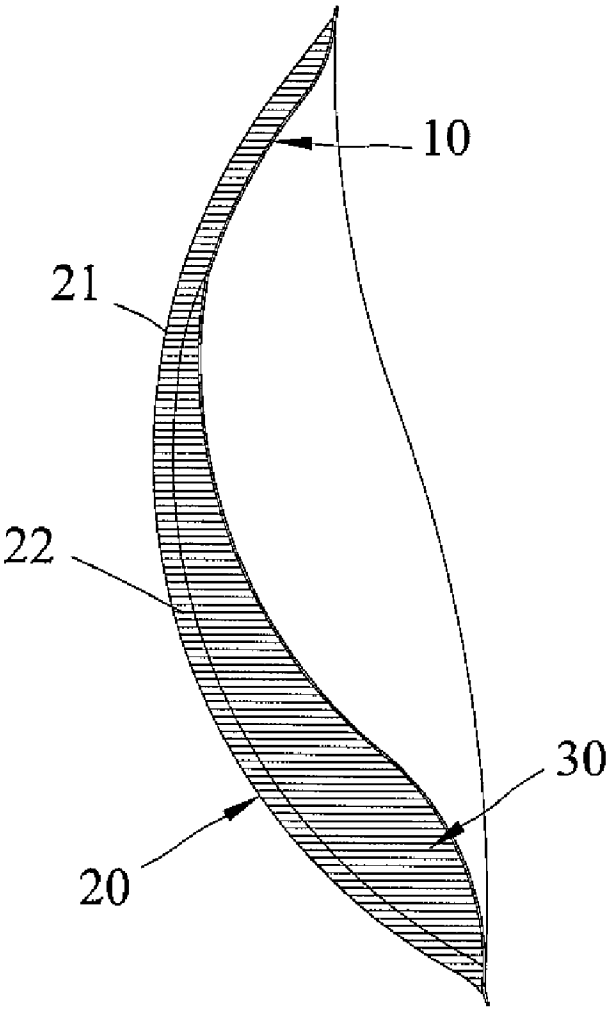
FIG. 11 is a cross sectional diagram of a high elastic fiber cup according to a second embodiment of the present invention.

With reference with FIG. 11, the high elastic fiber cup in accordance with another embodiment of the present invention comprises the inner layer 10 made of a double-side multispandex, the outer layer 20 comprised of a wrapping cloth 21 and a combed fiber sheet 22 which includes a high elastic fiber body a provided therein and is attached on the internal surface of the wrapping cloth 21.

Figure 13:
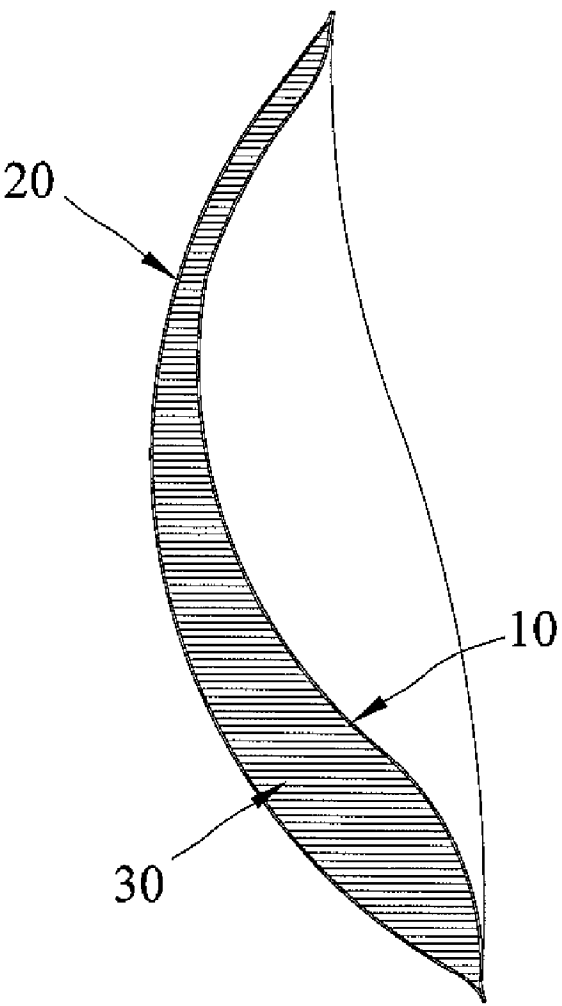
FIG. 13 is a cross sectional diagram of a high elastic fiber cup according to a fourth embodiment of the present invention.
Figure 12:
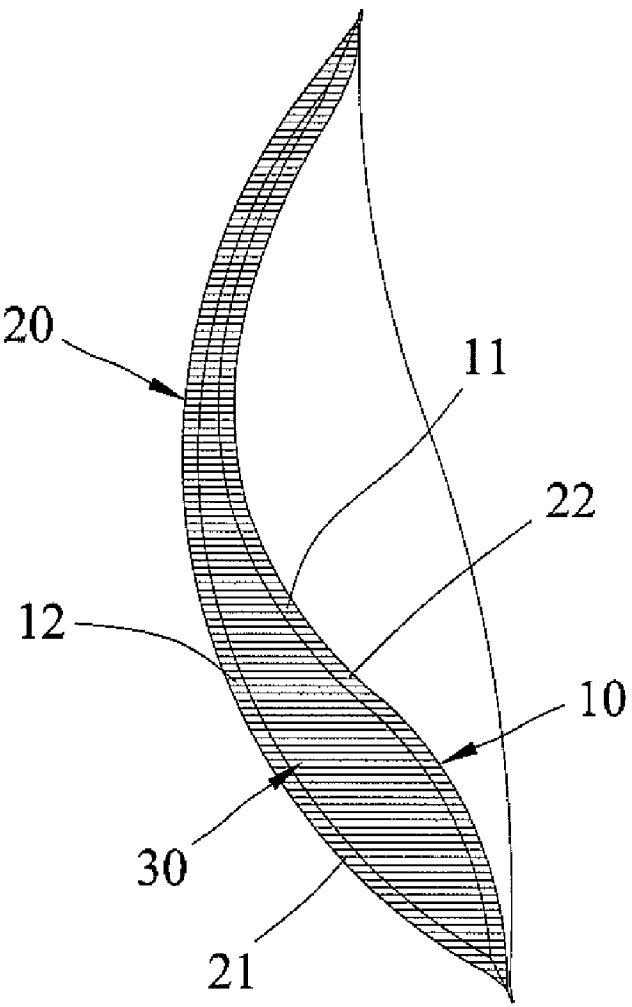
FIG. 12 is a cross sectional diagram of a high elastic fiber cup according to a third embodiment of the present invention.

As illustrated in FIGS. 12 and 13, the high elastic fiber cup in accordance with another embodiment of the present invention comprises the inner and outer layers 10, 20 both made of a double-side multispandex, or comprised of the wrapping clothes 11, 21 and combed fiber sheets 12, 22 which include the high elastic fiber bodies a provided therein and are attached on the internal surfaces of the wrapping clothes 11 and 21 respectively.

Figure 15:
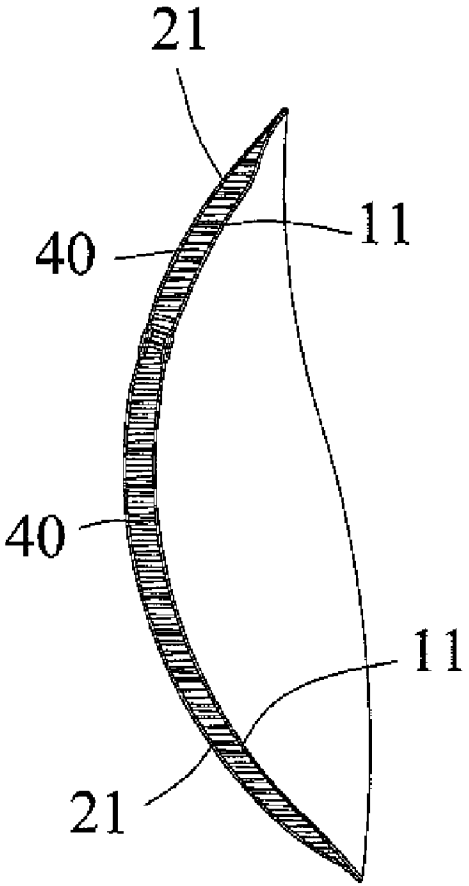
FIG. 15 is a cross sectional diagram of the high elastic fiber cup according to the fifth embodiment of the present invention.
Figure 14:
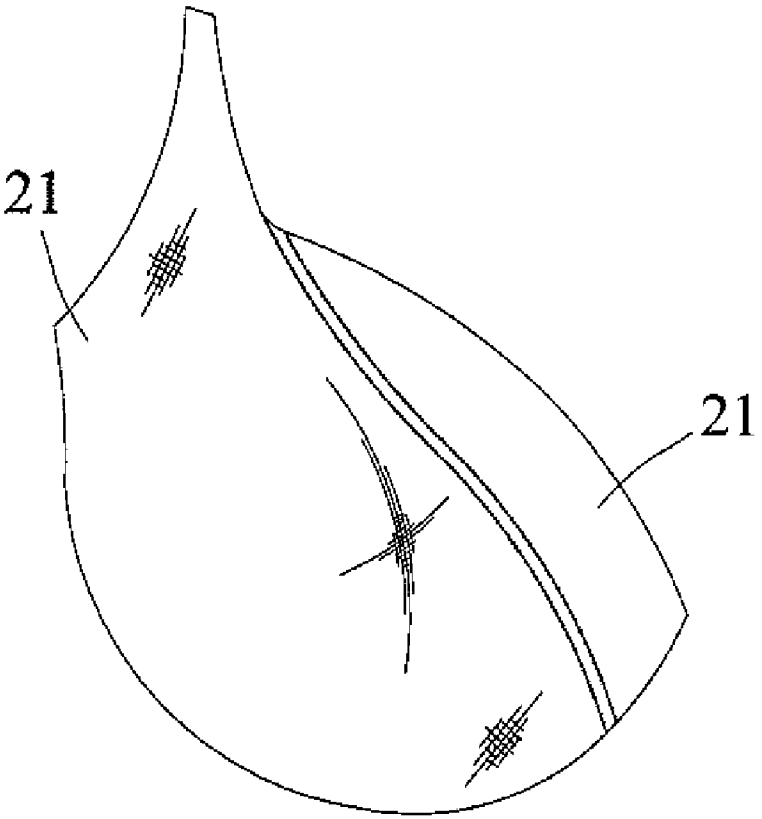
FIG. 14 is a perspective diagram of a high elastic fiber cup according to a fifth embodiment of the present invention.

Referring further to FIGS. 14 and 15, the high elastic fiber cup in accordance with another embodiment of the present invention includes a combed fiber sheet 40 made of the high elastic fiber body a cut based on a proper thickness and includes the wrapping clothes 11, 21 attached on two sides thereof and cut into a large and a small piece respectively. Thereafter, a three-dimensional cup is obtained in a sewing manner.

Figure 16:
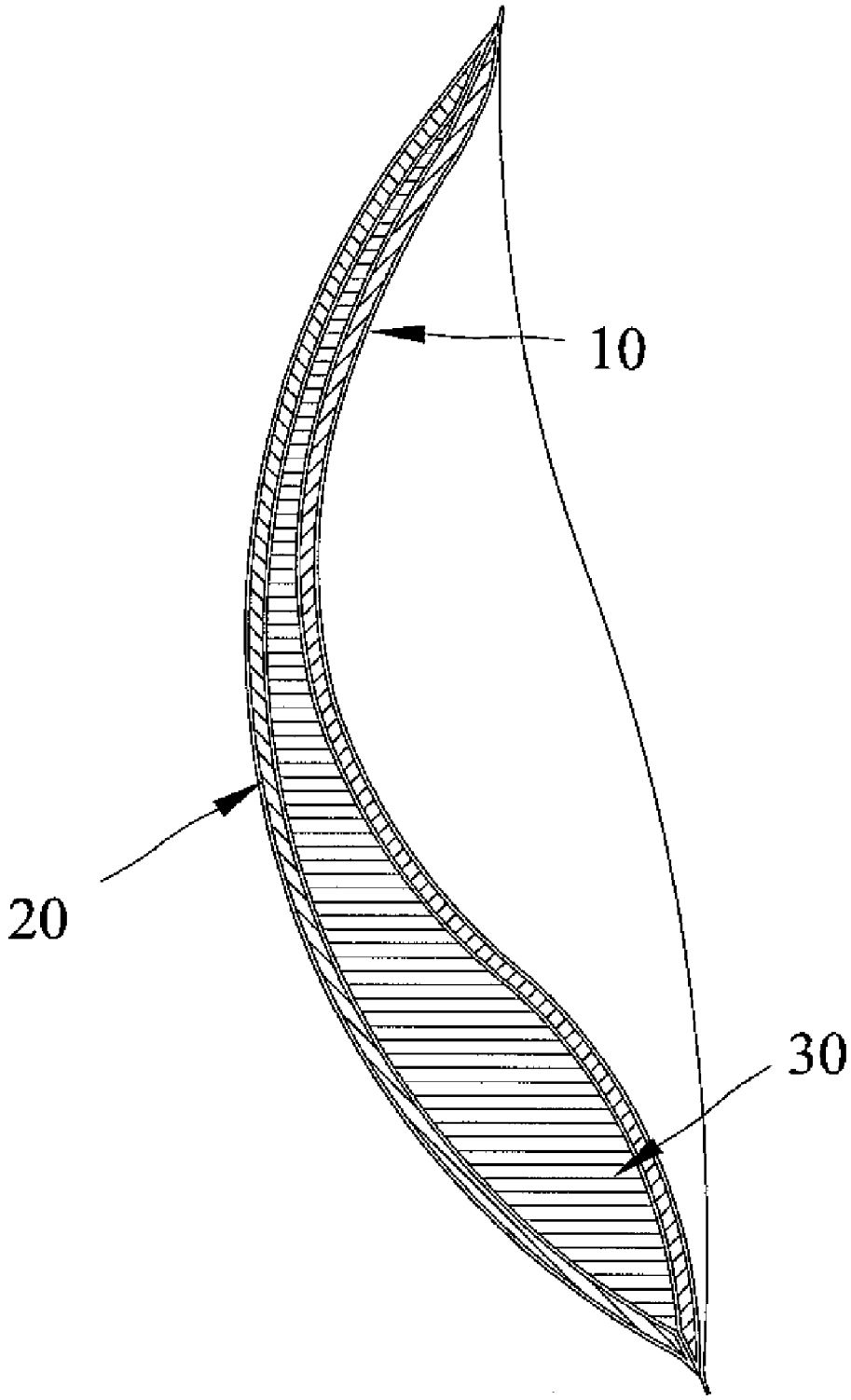
FIG. 16 is a cross sectional diagram of a high elastic fiber cup according to a sixth embodiment of the present invention.
Figure 18:
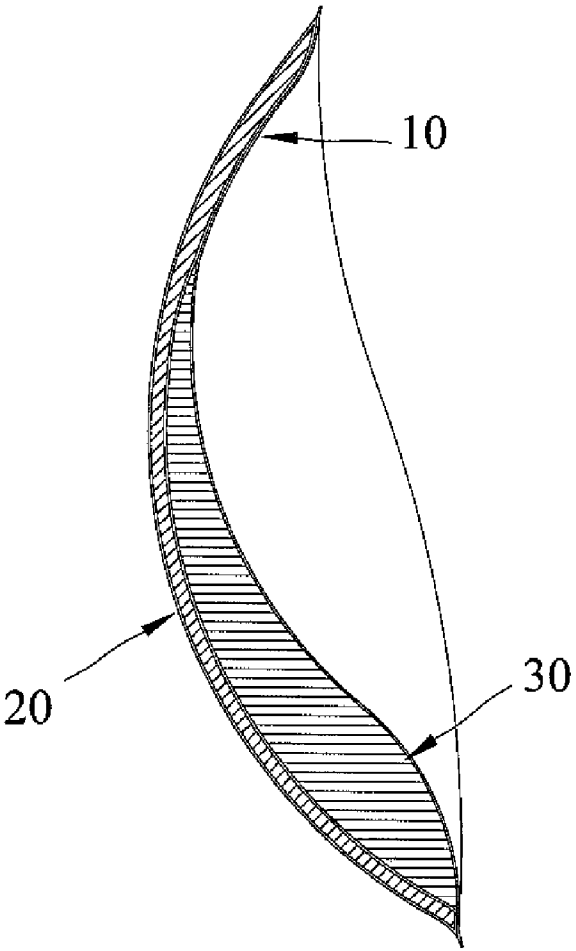
FIG. 18 is a cross sectional diagram of a high elastic fiber cup according to an eighth embodiment of the present invention.
Figure 17:
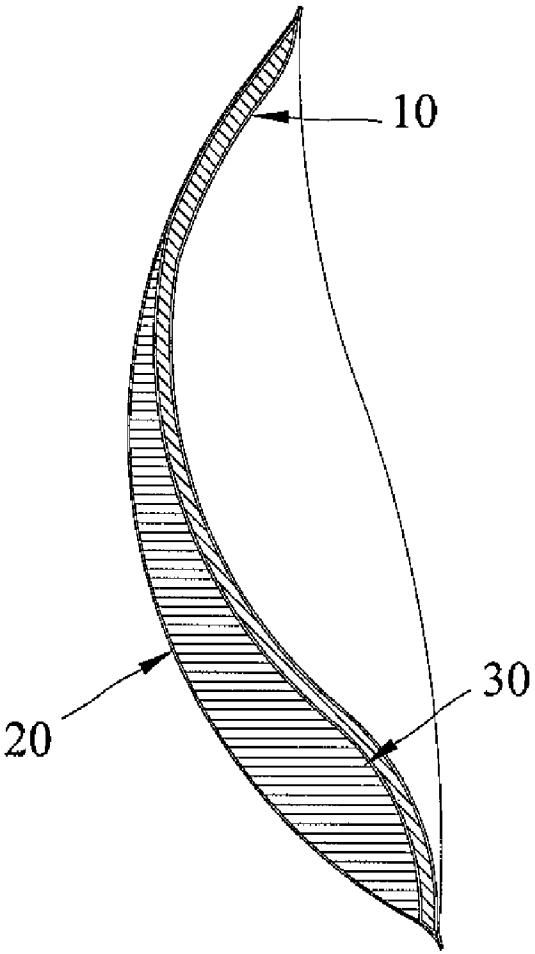
FIG. 17 is a cross sectional diagram of a high elastic fiber cup according to a seventh embodiment of the present invention.

As shown in FIGS. 16-18, the high elastic fiber cup in accordance with another embodiment of the present invention includes the inner and outer layers 10, 20 made of three layers of elastic fiber knitting cloth, or includes the inner layer 10 made of hail three layers of elastic fiber knitting cloth and the outer layer 20 made of a double-side multispandex, or includes the inner layer 10 made of a double-side multispandex and the outer layer 20 made of a three layers of elastic fiber knitting cloth, and includes the pad 30 made of the high elastic fiber body a cut into a three-dimensional shape. Besides, the inner and outer layers 10, 20 are applied on the inner surfaces thereof with gel. The pad 30 is attached to and between the inner and outer layers 10, 20 and then hot pressed to form a high elastic and air permeable cup.

It can be clearly seen from the preceding accounts on the features of the present invention that the high elastic fiber cup of the present invention has the following advantages:

1. By virtue of a vertically combed fiber, the present invention may have an excellent elasticity and air permeability so as to recover its initial shape quickly after being pressed and to achieve a comfortable satisfaction.

2. The service life of the present invention may be prolonged, even though the cup is washed repeatedly after use.

The invention is not limited to the above embodiments but various modifications thereof may be made. It will be understood by those skilled in the art that various changes in form and detail may made without departing from the scope and spirit of the present invention.

What is claimed is:

1. A high elastic fiber cup comprising:

an inner layer, an outer layer and a pad, wherein said pad is cut into a three-dimensional block and is attached to and between said inner and outer layers by using gel, with at least one of the inner layer, the outer layer, and the pad formed of a high elastic fiber body including a low melt PET elastic fiber, a self-crimp PET fiber, and another fiber, with the PET fibers each having a proportion of about 45 to 50% and the other fiber having a proportion of about 5 to 10%.

2. The high elastic fiber cup as claimed in claim 1, wherein at least one of said inner and outer layers includes a wrapping cloth having a combed fiber sheet formed of the high elastic fiber body attached on the inner surface thereof and cut with the combed fiber sheet.

3. The high elastic fiber cup as claimed in claim 1, wherein said inner and outer layers are both made of a double-side multispandex.

4. The high elastic fiber cup as claimed in claim 1, wherein said inner and outer layers are both made of a three-layer elastic fiber knitting cloth.

5. The high elastic fiber cup as claimed in claim 2, wherein said inner layer is comprised of said wrapping cloth and said combed fiber sheet and said outer layer is made of a double-side multispandex.

6. The high elastic fiber cup as claimed in claim 2, wherein said inner layer is made of a double-side multispandex, and said outer layer is comprised of said wrapping cloth and said combed fiber sheet.

7. The high elastic fiber cup as claimed in claim 1, wherein said inner layer is made of three layers of elastic fiber knitting cloth, and said outer layer is made of a double-side multispandex.

8. The high elastic fiber cup as claimed in claim 1, wherein said inner layer is made of a double-side multispandex, and said outer layer is made of three layers of elastic fiber knitting cloth.

* * * * *